US009184512B2

(12) United States Patent
Duan

(10) Patent No.: US 9,184,512 B2
(45) Date of Patent: Nov. 10, 2015

(54) CONNECTION TERMINAL, COAXIAL ELECTRICAL CONNECTOR AND WIRING STRUCTURE THEREOF

(71) Applicant: Yuntao Duan, Kunshan (CN)

(72) Inventor: Yuntao Duan, Kunshan (CN)

(73) Assignee: Kunshan Cocentra Electronics Co., Ltd., Kunshan (CN)

( * ) Notice: Subject to any disclaimer, the term of this patent is extended or adjusted under 35 U.S.C. 154(b) by 23 days.

(21) Appl. No.: 13/909,976

(22) Filed: Jun. 4, 2013

(65) Prior Publication Data

US 2013/0330968 A1 Dec. 12, 2013

(30) Foreign Application Priority Data

Jun. 12, 2012 (CN) ..... 2012 1 0191860

(51) Int. Cl.

| | |
|---|---|
| ***H01R 9/05*** | (2006.01) |
| ***H01R 4/00*** | (2006.01) |
| ***H01R 13/62*** | (2006.01) |
| ***H01R 4/48*** | (2006.01) |

(52) U.S. Cl.

CPC ..... *H01R 4/00* (2013.01); *H01R 4/489* (2013.01); *H01R 13/62* (2013.01); *H01R 9/0518* (2013.01)

(58) Field of Classification Search

CPC ..... H01R 24/58; H01R 9/0518

USPC ..... 439/669, 668, 934, 578, 585, 79, 388

See application file for complete search history.

(56) References Cited

U.S. PATENT DOCUMENTS

| | | | | |
|---|---|---|---|---|
| 7,938,681 | B2 * | 5/2011 | Lee et al. | 439/582 |
| 2012/0135637 | A1 * | 5/2012 | Chang | 439/585 |
| 2012/0329319 | A1 * | 12/2012 | Zhao | 439/578 |

* cited by examiner

*Primary Examiner* — Phuongchi T Nguyen

(74) *Attorney, Agent, or Firm* — CBM Patent Consulting, LLC

(57) ABSTRACT

Disclosed is a connection terminal, a coaxial electrical connector and a wiring structure thereof which could ensure the reliability of the electrical connection between the connection terminal and a coaxial cable core. The connection terminal includes a terminal body, two contact resilient pieces formed by bending and extending from two sides of the terminal body, and a core connection resilient arm extending from a rear end of the terminal body in a direction remote from the contact resilient pieces. The cross-section of the core connection resilient arm is essentially "Z" shaped, and a contact surface for contacting the coaxial cable core is formed on the core connection resilient arm. The contact surface has an arcuate protrusion protruding in a direction remote from the contact resilient pieces. The coaxial electrical connector and the wiring structure thereof all include the above connection terminal.

16 Claims, 5 Drawing Sheets

CONNECTION TERMINAL, COAXIAL ELECTRICAL CONNECTOR AND WIRING STRUCTURE THEREOF

TECHNICAL FIELD

The present invention relates to a connection terminal, a coaxial electrical connector and a wiring structure thereof, particularly to a connection terminal, a coaxial electrical connector and a wiring structure thereof, which are applicable to radio frequency (RF) technical field.

BACKGROUND ART

A coaxial electrical connector for cable adapter is an important part of RF technology. The coaxial electrical connector of the prior art largely consists of a connection terminal, an insulating core member and a shell, among which the connection terminal and the insulating core member function as critical components for stability of electrical connection. The stability of the connection between a coaxial cable core and a connector is mainly dependent on the structures of the connection terminal and the insulating core member themselves and their particular assembly structure with the cable. Therefore, the coaxial electrical connector of the prior art usually employs the connection terminal and the insulating core member of complex structures, wherein an interference contact with the cable core is made by mechanical crimp of the insulating core member and the connection terminal, thereby achieving electrical connection between the connection terminal and the cable core. However, the connection terminal and the insulating core member of complex structures would inevitably increase production cost, thus incurring a heavy burden of cost on the producers, because the coaxial electrical connector is a mass production part. Furthermore, the design of interference contact in the prior art is prone to poor contact due to the fact that conductive strands of the coaxial cable core tend to diverge, resulting in open circuit. Hence, a connection terminal, a coaxial electrical connector and a wiring structure thereof which could ensure the reliability of the electrical connection between the connection terminal and the cable core and meanwhile have simple structure and low cost are desired.

SUMMARY OF INVENTION

An object of the present invention is to overcome the above disadvantages in the prior art, and to provide a connection terminal, a coaxial electrical connector and a wiring structure thereof which could ensure the reliability of the electrical connection between the connection terminal and the coaxial cable core and meanwhile have simple structure and low cost.

The above object of the present invention is achieved by the following technical solutions:

As a first aspect of the present invention, a connection terminal includes a terminal body, two contact resilient pieces adapted for electrically contacting a complementary terminal and a core connection resilient arm. The two contact resilient pieces are formed by bending and extending from two sides of the terminal body. The core connection resilient arm extends from a rear end of the terminal body in a direction remote from the contact resilient pieces and includes a contact surface adapted for contacting a cable core. The cross-section of the core connection resilient arm is essentially "Z" shaped. The contact surface has an arcuate protrusion protruding in a direction remote from the contact resilient pieces.

In a preferred embodiment, the terminal body of the connection terminal includes opposing interference protrusions at a front end thereof. The two contact resilient pieces of the connection terminal are mirror-symmetrically arranged, and the opposing interference protrusions of the terminal body are mirror-symmetrically arranged. The terminal body of the connection terminal is of plate structure with a straight and flat plate surface. The protruding direction of the arcuate protrusion of the connection terminal is essentially opposite to the extending direction of the contact resilient pieces. The terminal body of the connection terminal defines a sight hole therethrough.

As a second aspect of the present invention, a coaxial electrical connector includes a connection terminal as described in the first aspect, an insulating core member accommodating the connection terminal therein and a shell arranged outside the insulating core member. The insulating core member includes an insulating body and an insulating core pressing block extending upwards from one side of the insulating body. The insulating body is provided with a cable core groove adapted for accommodating a cable core of a coaxial cable and a terminal-receiving chamber securing the connection terminal therein. The cable core groove and the terminal-receiving chamber communicate with each other.

In a preferred embodiment, the core connection resilient arm of the connection terminal is received in another side of the insulating body opposite to a lower end of the insulating core pressing block. The shell includes a mounting base and a bending portion extending upwards from one side of the mounting base and accommodating the insulating core pressing block therein. The mounting base accommodates the insulating body of the insulating core member and the connection terminal therein. The bending portion is forced to bend downwards together with the insulating core pressing block during the coaxial electrical connector is assembled with a core exposing end portion of the coaxial cable, whereby the insulating core pressing block presses the cable core of the coaxial cable therebelow, thus allowing the cable core to be electrically connected with the connection terminal and allowing the shell to enclose and cover the insulating core member, the connection terminal and the core exposing end portion of the coaxial cable.

In a preferred embodiment, the insulating core pressing block is provided with a first engagement portion and a second engagement portion arranged from the lower end to an upper end thereof. The first engagement portion includes a protrusion stage protruding inwardly towards the insulating body. The second engagement portion includes a trapezoidal block formed at a top end thereof.

As a third aspect of the present invention, a wiring structure of a coaxial electrical connector includes a coaxial electrical connector as described in the second aspect and a coaxial cable having a core exposing end portion with a cable core exposed. The exposed cable core of the coaxial cable is accommodated inside the cable core groove of the insulating core member. The core exposing end portion of the coaxial cable together with the connection terminal and the insulating core member are all enclosed inside the shell by bending the bending portion of the shell and the insulating core pressing block accommodated inside the bending portion. The exposed cable core of the coaxial cable is thus clamped between the insulating core pressing block of the insulating core member and the terminal body and the core connection resilient arm of the connection terminal, thereby establishing an electrical connection between the cable core and the connection terminal.

The following advantages and effects are achieved by the present invention: the cable core is clamped and compressed from its both sides by the insulating core pressing block of the insulating core member and the connection terminal with a "Z" shaped core connection resilient arm after the shell being bent for contacting and securing, therefore the reliability of the electrical connection between the connection terminal and the cable core could be improved, and the production cost could be effectively reduced.

DESCRIPTION OF THE ACCOMPANYING DRAWINGS

Wherein:

1—terminal body, 2—contact resilient piece, 3—core connection resilient arm, 4—interference protrusion, 5—sight hole, 6—insulating core member, 7—shell, 8—cable core groove, 9—terminal-receiving chamber, 10—insulating core pressing block, 11—mounting base, 12—anti-disengagement slot, 13—anti-disengagement block, 14—retainer column, 15—retainer cutout, 16—trunking, 17—first enclasp resilient piece, 18—second enclasp resilient piece, 19—enclasp protrusion, 20—cable, 21—bending piece, 22—accommodating chamber, 23—connection terminal, 24—cable core, 25—insulating body, 26—first engagement portion, 27—second engagement portion, 28—protrusion stage, 29—contact surface, 30—bending portion.

DETAILED DESCRIPTION OF THE EMBODIMENTS

The present invention will be further described in detail in connection with embodiments and accompanying drawings.

Figure 1:
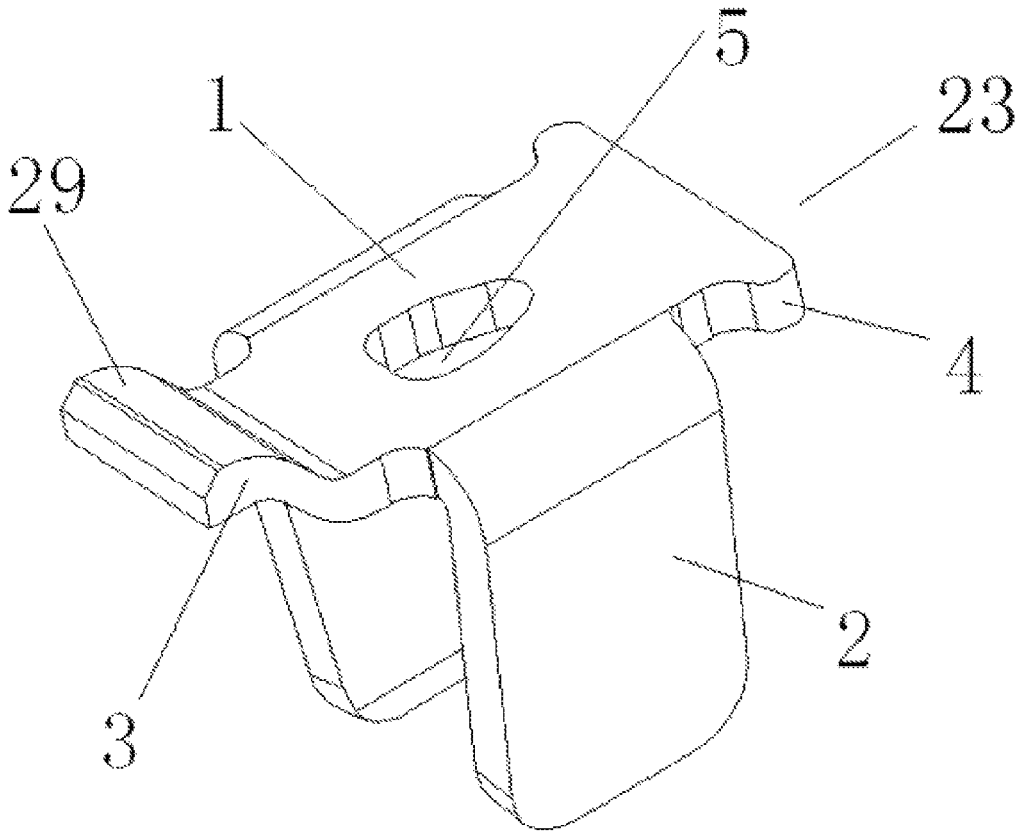
FIG. 1 is a structural schematic diagram showing a connection terminal of a preferred embodiment of the present invention.

As shown in FIG. 1, a connection terminal 23 according to a preferred embodiment of the present invention includes a terminal body 1, two contact resilient pieces 2 and a core connection resilient arm 3. The terminal body 1, the contact resilient pieces 2 and the core connection resilient arm 3 are integrally formed from a piece of metal material.

Figure 2:
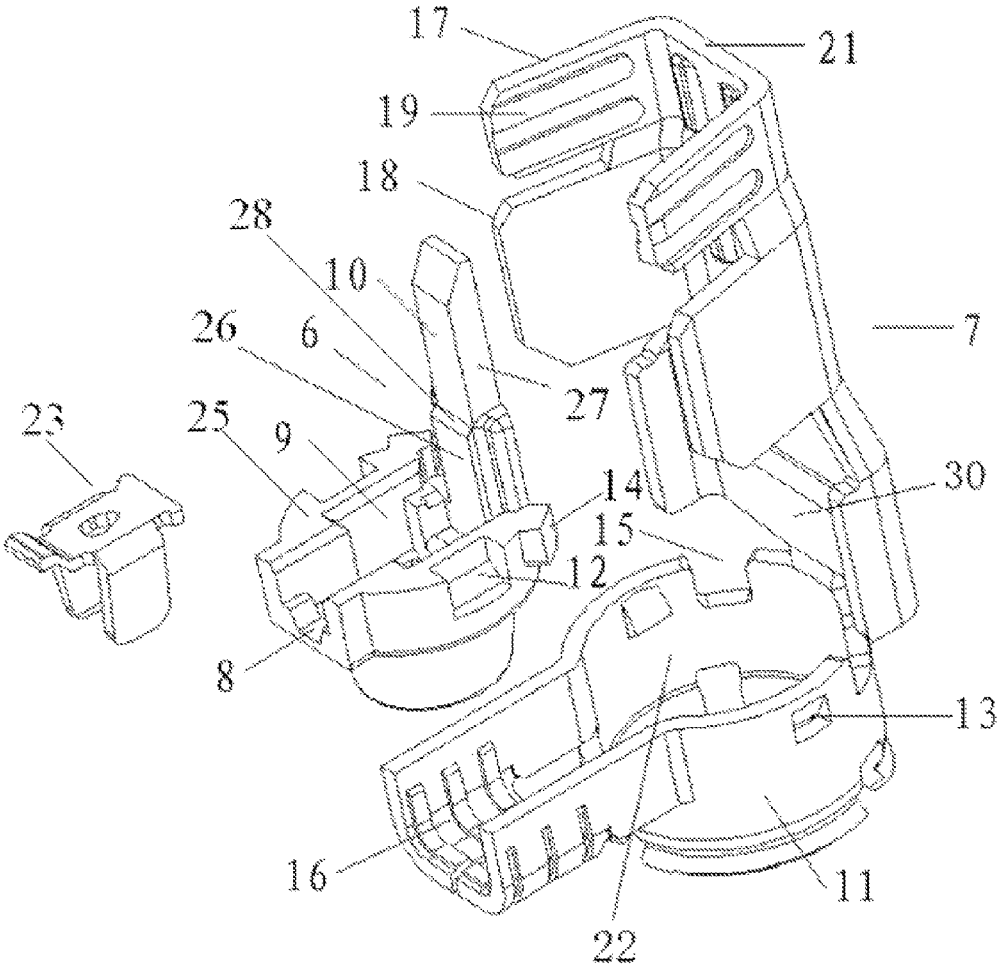
FIG. 2 is an exploded structural schematic diagram showing a coaxial electrical connector of a preferred embodiment of the present invention.
Figure 4A:
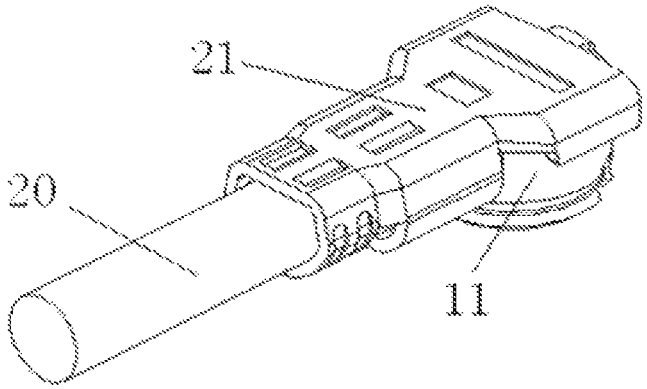
FIG. 4A is a top view of structural schematic diagram showing a wiring structure of a coaxial electrical connector of a preferred embodiment of the present invention, in a status of the shell being bent for enclosing.
Figure 4B:
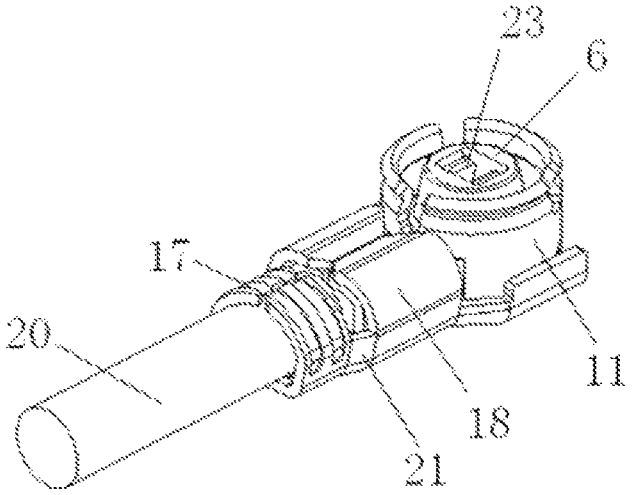
FIG. 4B is a bottom view of structural schematic diagram showing a wiring structure of a coaxial electrical connector of a preferred embodiment of the present invention, in a status of the shell being bent for enclosing.

The contact resilient pieces 2 are arranged on the both sides of the terminal body 1. Referring to FIGS. 2 and 4, the contact resilient pieces 2 serve to establish electrical contact with a complementary terminal of an electrical mating connector after the connection terminal 23 is assembled together with an insulating core member 6 and a shell 7 to form an electrical connector. As shown in FIG. 1, the contact resilient pieces 2 are formed by bending and extending from the two sides of the terminal body 1, and they are commonly mirror-symmetrically arranged. The core connection resilient arm 3 is located at a rear end of the terminal body 1, and essentially extends obliquely upwards in a direction remote from the terminal body 1. To ensure the reliability of electrical contact between the connection terminal 23 and a cable core 24 of a coaxial cable 20, the cross-section of the core connection resilient arm 3 is essentially "Z" shaped. More specially, as shown in FIG. 1, the cross-section of the core connection resilient arm 3 could be largely divided into three parts. The first part is configured to further extend from the rear end of the terminal body 1, which forms a first horizontal side edge of the "Z" shaped cross-section and acts as a transitional portion. The second part extends obliquely from the first part in a direction remote from the terminal body 1. In reference to FIG. 1, the second part obliquely extends toward the upper left above the terminal body 1. The second part mainly functions as a resilient support portion, which forms a middle section of the "Z" shaped cross-section. It should be noted that the direction of the middle section is reversed relative to the oblique direction of a character "Z", and the first part and the second part are correspondingly staggered. The third part extends essentially in the same direction as the first part. It should also be noted that the shape of the third part is similar to an arch, such that the third part possesses an arcuate contact surface 29 which produces an arcuate protrusion protruding in a direction away from the contact resilient pieces 2 for contacting with the cable core 24, thereby improving the reliability of the contact with the cable core 24. As a preferred embodiment, the arcuate shape of the arcuate contact surface 29 is part of a circular arc, and the protrusion direction of the arcuate protrusion is essentially opposite to the extending direction of the contact resilient pieces 2. As the contact surface 29 is arcuate, the pressing force generated by the elasticity of the whole core connection resilient arm 3 is concentrated at the contact area with the cable core 24, thus making the electrical contact between the core connection resilient arm 3 and the cable core 24 more stable.

As a preferred embodiment, a front end of the terminal body 1, i.e. the end remote from the core connection resilient arm 3, is provided with two interference protrusions 4 which protrude in the opposing directions. The two interference protrusions 4 are commonly mirror-symmetrically arranged.

As shown in FIG. 1, as a preferred embodiment, the terminal body 1 is of plate structure with a straight and flat plate surface, and defines a sight hole 5 therethrough for visual alignment inspection of the cable core 24.

Figure 3:
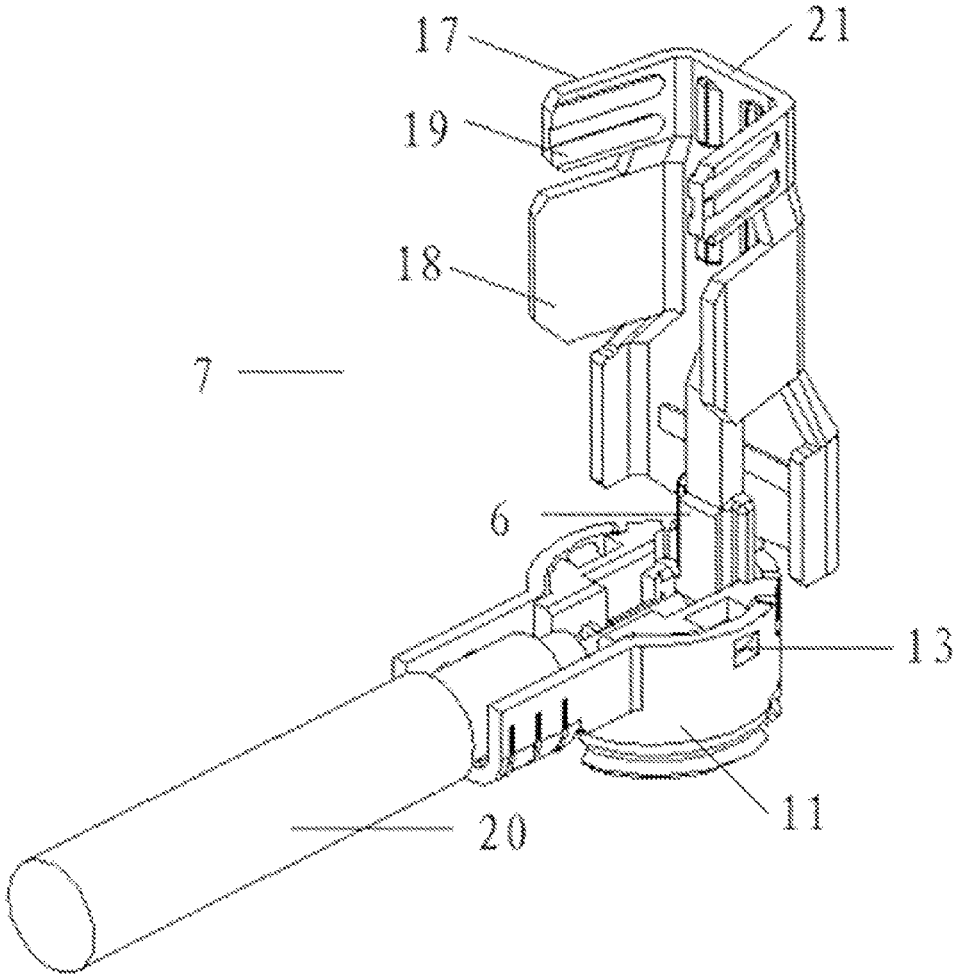
FIG. 3 is a structural schematic diagram showing a wiring structure of a coaxial electrical connector of a preferred embodiment of the present invention, in a status of each components being mounted to their positions but the shell not being bent to enclose them yet.

As shown in FIGS. 2-3, besides the connection terminal 23 described above, the coaxial electrical connector of the present invention further includes an insulating core member 6 and a shell 7. It should be noted that the shell 7 is generally made of metal material with high ductility such as gold plating copper, which is due to the fact that the shell 7 would be utilized to enclose the interior components including the insulating core member 6 and the connection terminal 23 after assembly. The insulating core member 6 is generally made of insulating material such as plastic, which is due to the fact that the insulating core member 6 would be utilized to insulate the cable core 24 and the connection terminal 23 from the shell 7.

The coaxial electrical connector of the present invention refers to a coaxial electrical connector including the connection terminal 23, the insulating core member 6 and the shell 7 of the present invention and not being connected with a coaxial cable 20. When the coaxial electrical connector has not been connected with the coaxial cable 20, both the shell 7 and the insulating core member 6 remain not being bent for enclosing, the coaxial electrical connector retains a natural state as an independent product. Therefore, the coaxial electrical connector in this natural state will be described in detail as follows.

Figure 5:
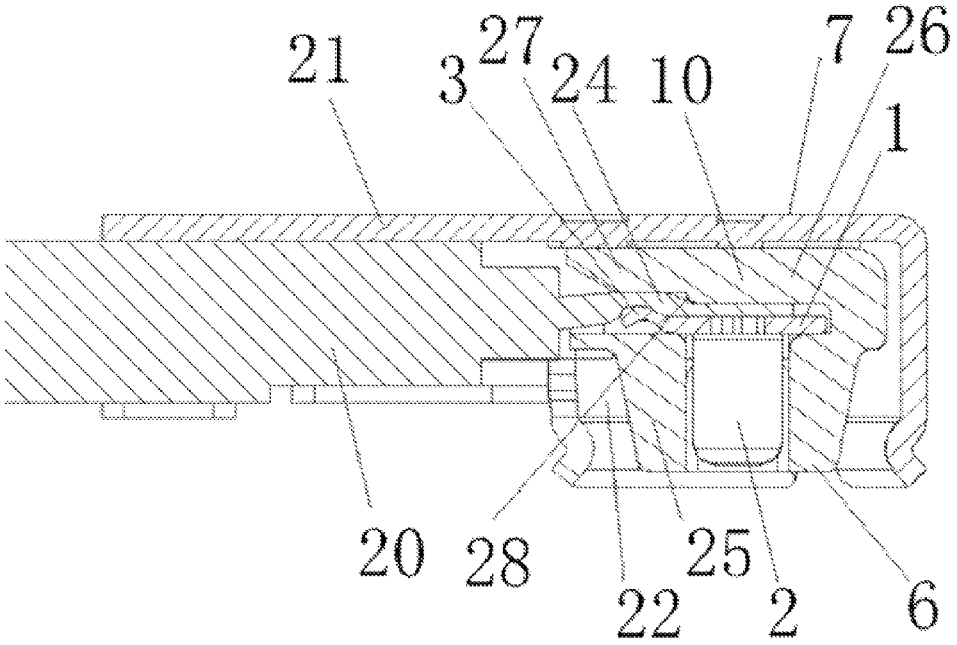
FIG 5 is a cross-sectional view of the wiring structure in FIG. 4.

The insulating core member 6 includes an insulating body 25 and an insulating core pressing block 10. The interior of the insulating body 25 is provided with a terminal-receiving chamber 9 for accommodating the connection terminal 23 and a portion of the insulating core pressing block 10. It should be noted that, as shown in FIG. 5, the insulating body 25 is supplied with a communication structure which allows the contact resilient pieces 2 of the connection terminal 23 to contact a complementary terminal outside the insulating core member 6.

In addition, there is provided a cable core groove 8 communicating with the terminal-receiving chamber 9 in the interior of the insulating body 25, so that the cable core 24 of the coaxial cable 20 could contact with the connection terminal 23 received in the insulating core member 6. The insulating core pressing block 10 which is formed on one side of the insulating body 25 protrudes outwards (upwards in the figure), and the insulating core pressing block 10 is bent during assembly for clamping and compressing the cable core 24 of the cable 20 in cooperation with the connection terminal 23 and meanwhile insulating the cable core 24. Accordingly, the configuration of the insulating core pressing block 10 should match the shapes of the terminal-receiving chamber 9 and the cable core groove 8 after being bent. As a preferred embodiment, the insulating core pressing block 10 is provided with a first engagement portion 26 and a second engagement portion 27 of different shapes arranged from a lower end to an upper end thereof, wherein the first engagement portion 26 protrudes inwardly towards the insulating core member 6 to produce a protrusion stage 28. The advantageous effect of such a configuration lies in the fact that the insulating core pressing block 10 after being bent could be properly arranged above the connection terminal 23 and thereby could solidly clamp the exposed cable core 24 of the coaxial cable 20 between the insulating core pressing block 10 and the connection terminal 23 in cooperation with the terminal body 1 and the core connection resilient arm 3 of the connection terminal 23, such that a reliable electrical engagement of the cable core 24 and the connection terminal 23 could be achieved. As a further preferred embodiment, a trapezoidal block is formed at a top end of the second engagement portion 27.

As a preferred embodiment, interference grooves corresponding to the interference protrusions 4 of the connection terminal 23 are provided inside the terminal-receiving chamber 9.

The shell 7 serves to accommodate and secure the insulating core member 6 and an end portion of the coaxial cable 20 that exposes the cable core 24 (hereinafter referred to as "core exposing end portion"). As a result, the shell 7 includes a mounting base 11 and a bending portion 30. The mounting base 11 is of shell structure the shape of which is similar to that of the insulating body 25 of the insulating core member 6, and includes an accommodating chamber 22 and a trunking 16. As shown in FIGS. 2, 3 and 5, the top of the mounting base 11 is open, thereby facilitating accommodation of the insulating core member 6 with the connection terminal 23 received therein and the core exposing end portion of the cable 20 into the accommodating chamber 22 and the trunking 16. The bottom of the mounting base 11 is configured to be a step structure which could allow the insulating core member 6 to expose while still restrict the position of the insulating core member 6. As a preferred embodiment, in order to attain better securing of the insulating core member 6 to the shell 7 and prevent relative rotation and displacement therebetween, anti-disengagement slots 12 are defined in the outer side of the insulating body 25 of the insulating core member 6, and anti-disengagement blocks 13 for fitting into the anti-disengagement slots 12 are correspondingly arranged on the inner side wall of the mounting base 11 of the shell 7. Retainer columns 14 are arranged on the outer side of the insulating body 25 of the insulating core member 6, and retainer cutouts 15 are correspondingly provided in the side wall of the mounting base 11 of the shell 7.

In order to effectively form a fixed connection with the cable 20, the mounting base 11 of the shell 7 is provided with the trunking 16 for surrounding and clamping the periphery of the cable 20, and the bending portion 30 of the shell 7 is provided with a bending piece 21 for being disposed on the outer side of the insulating core pressing block 10 after assembly and a first enclasp resilient piece 17 and a second enclasp resilient piece 18 arranged on both sides of the bending piece 21. The size of the first enclasp resilient piece 17 is smaller than the size of the second enclasp resilient piece 18, and the second enclasp resilient piece 18 is located between the first enclasp resilient piece 17 and the accommodating chamber 22. After the connection terminal 23, the insulating core member 6 and the cable 20 being assembled, the upper side of the cable 20 is covered by bending the bending piece 21, and the cable 20 and the trunking 16 are enclasped by the first enclasp resilient piece 17 and the second enclasp resilient piece 18, such that the assembly could be completed.

As a preferred embodiment, enclasp protrusions 19 are formed on the inner side of the first enclasp resilient piece 17 to enclasp the cable 20 better.

The wiring structure composed of the coaxial electrical connector of the present invention as described above and the coaxial cable 20 would be described in detail in connection with FIGS. 4-5.

The connection terminal 23 is arranged inside the terminal-receiving chamber 9 of the insulating body 25 of the insulating core member 6. The core connection resilient arm 3 of the connection terminal 23 is located on one side of the insulating body 25 opposite to the lower end of the insulating core pressing block 10. The insulating core member 6 with the connection terminal 23 received therein is arranged in the accommodating chamber 22 of the mounting base 11 of the shell 7. The core exposing end portion of the coaxial cable 20 is arranged in the trunking 16 of the mounting base 11 from the top of the mounting base 11 using the sight hole 5 of the connection terminal 23 as alignment reference, and the cable core 24 extends into the terminal-receiving chamber 9 of the insulating body 25 and contacts the connection terminal 23. The shell 7 encloses the core exposing end portion of the cable 20 together with the connection terminal 23 and the insulating core member 6 and secures them internally by bending the bending portion 30 downwards. The bending piece 21 is bent until it closely aligns with the outer side of the insulating core pressing block 10. The first enclasp resilient piece 17 coats the outer periphery of the cable 20 closely, and the second enclasp resilient piece 18 coats the outer side of the trunking 16 closely. The insulating core pressing block 10 is arranged between the bending piece 21 and the cable core 24 of the cable 20 in a bending status.

As shown in FIG. 5, the exposed cable core 24 of the coaxial cable 20 is clamped between the insulating core pressing block 10 of the insulating core member 6 and the terminal body 1 and the core connection resilient arm 3 of the connection terminal 23 after being enclosed by the shell 7. More specially, the free end of the cable core 24 is interferingly clamped between the protrusion stage 28 of the first engagement portion 26 of the insulating core pressing block 10 and the terminal body 1, and the inner end of the cable core 24 is elastically clamped between the small-sized second engagement portion 27 of the insulating core pressing block 10 and the core connection resilient arm 3 of the connection terminal 23. The core connection resilient arm 3 applies a positive force to the cable core 24 via its arcuate contact surface 29 in a direction perpendicular to the extending direction of the cable core 24 (upwards in FIG. 5). Due to the design of clamping engagement, the cable core 24 could be stably adhered onto the surface of the connection terminal 23. The contact area between the cable core 24 and the connection terminal 23 could be significantly increased, and the electrical connection therebetween could be more stable and reliable. Therefore, the problem that contact area of the interference contact in the prior art is easy to decrease and even be disconnected due to the fact that conductive strands of the cable core 24 tend to diverge could be solved.

In summary, the following advantages and effects are achieved by the present invention: the connection terminal 23 of the present invention has special design, simple structure, easy manufacture process and low cost. By the cooperation of the special structure of the connection terminal 23 with the insulating core pressing block 10 of the insulating core member 6, the coaxial electrical connector and the wiring structure thereof using the connection terminal 23 of the present invention could achieve a stable and reliable electrical engagement between the connection terminal 23 and the cable core 24 of the coaxial cable, thereby overcoming the disadvantages of the prior art such as electrical disconnection and complicated structure.

However, the present invention is not limited to the above embodiments. Any other changes, modifications, alternatives, etc. without departing from spirit and principle of the present invention should be considered as equivalent substitutes and included within scopes of the present invention.

The invention claimed is:

1. A coaxial electrical connector, comprising a connection terminal 23 having a terminal body 1, two contact resilient pieces 2 adapted for electrically contacting a complementary terminal and a core connection resilient arm 3 having a resilient free end, wherein the two contact resilient pieces 2 are formed by bending and extending from two sides of the terminal body 1, wherein the core connection resilient arm 3 extends from a rear end of the terminal body 1 in a direction substantially perpendicular to the extending direction of the contact resilient pieces 2 and comprises a contact surface 29 provided at the resilient free end adapted for contacting a cable core 24, the cross-section of the core connection resilient arm 3 being essentially "Z" shaped, the contact surface 29 having an arcuate protrusion protruding in a direction remote from the contact resilient pieces 2, and wherein the core connection resilient arm 3 is resiliently deformable in the extending direction of the contact resilient pieces 2 to ensure the reliability of electrical connection between the connection terminal and the cable core 24 resiliently movable in the extending direction of the contact resilient pieces 2;

an insulating core member 6 accommodating the connection terminal 23 therein and a shell 7 arranged outside the insulating core member 6;

wherein the insulating core member 6 comprises an insulating body 25 and an insulating core pressing block 10 extending upwards from one side of the insulating body 25, the insulating body 25 being provided with a cable core groove 8 adapted for accommodating a cable core 24 of a coaxial cable 20 and a terminal-receiving chamber 9 securing the connection terminal 23 therein, the cable core groove 8 and the terminal-receiving chamber 9 being communicating with each other;

wherein the core connection resilient arm 3 of the connection terminal 23 is received in another side of the insulating body 25 opposite to a lower end of the insulating core pressing block 10;

wherein the shell 7 comprises a mounting base 11 and a bending portion 30 extending upwards from one side of the mounting base 11 and accommodating the insulating core pressing block 10 therein, the mounting base 11 accommodating the insulating body 25 of the insulating core member 6 and the connection terminal 23 therein, the bending portion 30 being forced to bend downwards together with the insulating core pressing block 10 during the coaxial electrical connector being assembled with a core exposing end portion of the coaxial cable 20 with a cable core 24 exposed, whereby the insulating core pressing block 10 contacts and presses the exposed cable core 24 of the coaxial cable 20 therebelow, thus allowing the exposed cable core 24 to be electrically connected with the connection terminal 23 and allowing the shell 7 to enclose and cover the insulating core member 6, the connection terminal 23 and the core exposing end portion of the coaxial cable 20; and wherein the core connection resilient arm 3 of the connection terminal 23 is upwardly and downwardly deformable in the insulating body 25 of the insulating core member 6 to ensure the reliability of electrical connection between the connection terminal 23 and the cable core 24.

2. The coaxial electrical connector according to claim 1, wherein the terminal body 1 is of plate structure with a straight and flat plate surface.

3. The coaxial electrical connector according to claim 1, wherein the protruding direction of the arcuate protrusion is essentially opposite to the extending direction of the contact resilient pieces 2.

4. The coaxial electrical connector according claim 1, wherein the terminal body 1 defines a sight hole 5 therethrough.

5. The coaxial electrical connector according to claim 1, wherein the terminal body 1 comprises opposing interference protrusions 4, the interference protrusions 4 being provided at a front end of the terminal body 1 and being opposite to the core connection resilient arm 3.

6. The coaxial electrical connector, according to claim 5, wherein the two contact resilient pieces 2 are mirror-symmetrically arranged, and the opposing interference protrusions 4 are mirror-symmetrically arranged.

7. The coaxial electrical connector according to claim 1, wherein the insulating core pressing block 10 is provided with a first engagement portion 26 and a second engagement portion 27 respectively arranged from the lower end to an upper end thereof, the first engagement portion 26 comprising a protrusion stage 28 protruding inwardly towards the insulating body 25.

8. The coaxial electrical connector according to claim 7, wherein the second engagement portion 27 of the insulating core pressing block 10 comprises a trapezoidal block formed at a top end thereof.

9. A wiring structure, comprising a coaxial electrical connector according to claim 1 and a coaxial cable 20 having a core exposing end portion with a cable core 24 exposed, the exposed cable core 24 of the coaxial cable 20 being accommodated inside the cable core groove 8 of the insulating core member 6, the core exposing end portion of the coaxial cable

20 together with the connection terminal 23 and the insulating core member 6 being enclosed inside the shell 7 by bending the bending portion 30 of the shell 7 and the insulating core pressing block 10 accommodated inside the bending portion 30, wherein the exposed cable core 24 of the coaxial cable 20 is clamped between the insulating core pressing block 10 of the insulating core member 6 and the terminal body 1 and the core connection resilient arm 3 of the connection terminal 23, and wherein the core connection resilient arm 3 of the connection terminal 23 is resiliently movable toward the exposed cable core 24 of the coaxial cable 20, thereby establishing a reliable electrical connection between the exposed cable core 24 and the connection terminal 23.

10. The wiring structure according to claim 9, wherein the terminal body 1 of the connection terminal 23 is of plate structure with a straight and flat plate surface.

11. The wiring structure according to claim 9, wherein the protruding direction of the arcuate protrusion of the connection terminal 23 is essentially opposite to the extending direction of the contact resilient pieces 2.

12. The wiring structure according claim 9, wherein the terminal body 1 of the connection terminal 23 defines a sight hole 5 therethrough.

13. The wiring structure according to claim 9, wherein the insulating core pressing block 10 of the insulating core member 6 is provided with a first engagement portion 26 and a second engagement portion 27 respectively arranged from the lower end to an upper end thereof, the first engagement portion 26 comprising a protrusion stage 28 protruding inwardly towards the insulating body 25.

14. The wiring structure according to claim 13, wherein the second engagement portion 27 of the insulating core pressing block 10 comprises a trapezoidal block formed at a top end thereof.

15. The wiring structure according to claim 9, wherein the terminal body 1 of the connection terminal 23 comprises opposing interference protrusions 4, the interference protrusions 4 being provided at a front end of the terminal body 1 and being opposite to the core connection resilient arm 3.

16. The wiring structure according to claim 15, wherein the two contact resilient pieces 2 of the connection terminal 23 are mirror-symmetrically arranged, and the opposing interference protrusions 4 of the terminal body 1 are mirror-symmetrically arranged.

* * * * *

UNITED STATES PATENT AND TRADEMARK OFFICE

CERTIFICATE OF CORRECTION

PATENT NO. : 9,184,512 B2
APPLICATION NO. : 13/909976
DATED : November 10, 2015
INVENTOR(S) : Duan It is certified that error appears in the above-identified patent and that said Letters Patent is hereby corrected as shown below:

In the Claims

Col. 7, lines 57-58, claim 1, Delete, "resiliently movable in the extending direction of the contact resilient pieces 2"

Signed and Sealed this
Twenty-third Day of February, 2016

Michelle K. Lee

Michelle K. Lee
*Director of the United States Patent and Trademark Office*